United States Patent [19]

Gerrick, Jr.

[11] 4,341,105

[45] Jul. 27, 1982

[54] FORCE MULTIPLIER FOR PUNCH PRESSES

[76] Inventor: Steven J. Gerrick, Jr., 6816 Parma Park Blvd., Parma Heights, Ohio 44130

[21] Appl. No.: 185,198

[22] Filed: Sep. 8, 1980

[51] Int. Cl.[3] ..... B21J 9/12

[52] U.S. Cl. ..... 72/453.02; 60/593; 92/52; 100/269 R

[58] Field of Search ..... 72/453.02, 453.01, 453.07, 72/453.18, 453.03; 100/269 R; 60/593; 92/52, 53

[56] References Cited

U.S. PATENT DOCUMENTS 4,206,684 6/1980 Gosney ..... 92/53

FOREIGN PATENT DOCUMENTS 39285 8/1979 France ..... 72/453.02
500658 11/1954 Italy ..... 72/453.01
2051 of 1906 United Kingdom ..... 60/593
683847 9/1979 U.S.S.R. ..... 72/453.02

*Primary Examiner*—Gene Crosby
*Attorney, Agent, or Firm*—Meyer, Tilberry & Body

[57] ABSTRACT

A force multiplier for a punch press which is sufficiently compact as to be placed in the normal throat opening of such press and yet enables the press to increase its working force by one and one-half to three times. The multiplier has a platen having a large diameter piston on its upper surface which piston has a sleeve on its upper surface, the outer surface of which is in engagement with a cylindrical wall in an upper base plate and the inner surface of which forms a cylinder wall for a second piston of smaller diameter which is engaged by the platen of the punch press.

5 Claims, 1 Drawing Figure

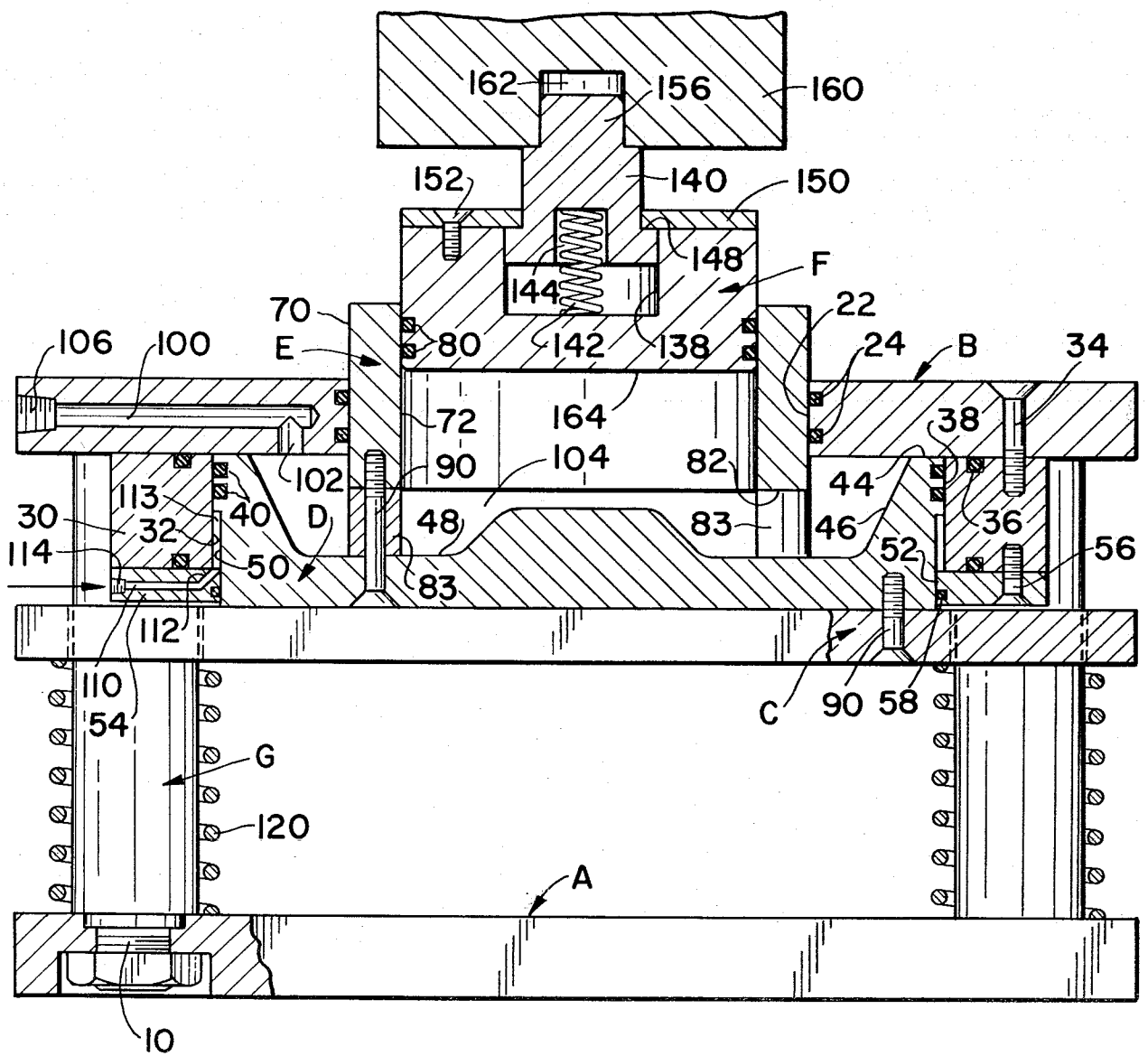
160
150
F
22
24
34
56
36
38
B
44
46
52
58
90
C
156
140
148
138
82
83
162
142
164
104
144
A
152
80
72
90
48
83
70
E
102
D
40
50
G
120
100
113
32
112
10
106
30
114
110
54

FORCE MULTIPLIER FOR PUNCH PRESSES

This invention pertains to the art of punch presses, sometimes known as arbor presses, and, more particularly, to apparatus which will enable the effective force of such a press to be increased beyond the maximum capacity of the press.

The invention is particularly applicable to a force multiplier for a punch press which is employed in blanking out pieces of metal from a base sheet of metal, which pieces of metal are to be subsequently formed in the press and will be described with particular reference thereto although it will be appreciated that the invention has other and broader applications.

BACKGROUND OF THE INVENTION

In the art of punch or arbor presses, such presses are designed for exerting a maximum downward force on a piece of sheet metal for the purpose of shearing, forming or drawing it. Such presses are normally rated by the maximum force in tons such as 25 ton, 50 ton, 100 ton or the like, which the press can safely exert.

The maximum force required to perform a particular operation on a piece of sheet metal can normally be calculated by determining the area of the metal to be acted on multiplied by a coefficient expressing the resistance of such metal to the type of deformation to be effected.

Ordinarily the largest area to be effected is in originally blanking out the piece to be formed from a base sheet of metal. In such case, the area to be cut or sheared from the base sheet metal equals the perimeter of the cut multiplied by the plate thickness and is normally greater than the area of any subsequent forming operation on the blank. Thus, if a piece of sheet metal is to be blanked out and then formed in the same punch press, the press will have to be rated at a force equal to that required to effect the blanking out operation. Thereafter, for the subsequent forming operations the press will only be operating at a fraction of its maximum rated capacity.

Oftentimes in manufacturing plants, it is desired to use a punch or arbor press large enough to do the subsequent forming operation but not large enough to do the blanking out operation. The invention is particularly applicable to such a situation and enables the use of a punch or arbor press having a rated capacity insufficient to perform the required blanking operation but a sufficient capacity to perform the forming operation.

THE INVENTION

In accordance with the present invention, apparatus is provided adapted to be placed between the platen and the base of a punch or arbor press which will enable the press to perform a forming or blanking operation requiring a total force greater than the maximum rated capacity of the press, comprised of: top and bottom horizontally disposed plates held in vertically spaced relationship by a plurality of column members; a platen member horizontally disposed and movable between the two plates and having on its upper surface a first large diameter piston slidable in a cylinder fastened to the bottom side of the upper plate; a sleeve on the upper surface of this first platen piston extending through a cylindrical opening in the upper plate in sealed relationship therewith; a second force piston of smaller diameter than the first platen piston extending beyond the top of the sleeve and slidably mounted in sealed relationship with the inner wall of the sleeve; and, hydraulic fluid in the cavity so formed between the two pistons such that when downward force is exerted on the second piston, the hydraulic fluid is placed under hydraulic pressure and exerts a force downwardly on the first piston and its associated platen proportional to the relative areas of the first and second pistons.

OBJECTS

The principal object of the invention is the provision of a new and improved apparatus for multiplying the force output of an arbor or punch press which is simple in construction, relatively economical to manufacture and which is effective to multiply the maximum force of the press at least 1.5 to 2 times.

Another object of the invention is the provision of a new and improved apparatus acting as a force multiplier for an arbor or punch press which is rugged in construction and which has a minimum overall mechanical height for a given amount of force multiplication.

DRAWINGS

The invention may take physical form in certain parts and arrangements of parts, a preferred embodiment of which will be described in detail in this specification and illustrated in the accompanying drawing which forms a part hereof and wherein:

The single FIGURE is a cross-sectional view partly in elevation of a force multiplier for a punch or arbor press illustrating a preferred embodiment of the present invention.

PREFERRED EMBODIMENT

Referring now to the drawing wherein the showings are for the purposes of illustrating a preferred embodiment of the invention only and not for the purposes of limiting same, the FIGURE shows a force multiplier adapted to be placed between the platen and base of an arbor or punch press comprised generally of: a base plate A; a top plate B; a platen C on the upper surface of which is fastened a first piston member D which piston has fastened to its upper surface a sleeve E which sleeve E has slidable on the interior thereof a second or force piston F.

The base plate A and top plate B are held in rigid vertically spaced relationship by a plurality of pillars G, and the platen C has openings therein through which the pillars G extend and the platen C is thus guided by the pillars G during its vertical movement.

The base plate A may take any known shape or form but in the embodiment shown is a thick heavy rectangular plate of steel to which the pillars G are fastened by bolts 10 extending from their lower ends through bolt openings in the plate. In the embodiment shown, four such pillars are employed, each one located at a respective corner of the base plate A.

The top plate B may also be made of steel and it is normally of the same dimensions and thickness as the base plate A and is similarly fastened to the upper ends of the pillars G by bolts (not shown) extending therefrom. The upper plate B, in accordance with the invention and as will be described hereinafter, has a central cylindrical opening defined by surface 22 with annular grooves midway of the length thereof containing sealing rings 24.

The platen C is generally of the same material, shape and size as the base plate A and top plate B and has openings in each corner which receive the pillars G and guide the platen C in its vertical movement.

A sleeve or ring 30 is fastened to the bottom side of the upper plate B and has an inner cylindrical surface 32 which forms a cylinder for the piston D. This ring 30 is fastened to the bottom side of the plate B by means of bolts 34. The upper annular end surface or edge of ring 30 between the bolts 34 and the inner surface 32 has an annular groove containing a sealing ring 36 engaging the bottom surface of the plate B, as is shown.

The piston D has an outer cylindrical surface 38 with a pair of circumferentially extending grooves therein containing packing members 40 in sealing engagement with the wall 32 of sleeve 30. In addition, the upper surface 44 of the piston D has a recess 46 to provide an upper recessed surface 48 spaced below the upper surface 44. While this recess is not absolutely necessary, it does result in reducing the overall height of the force multiplier which is necessary in some instances with punch or arbor presses which have a relatively small throat opening when fully retracted.

The lower outer periphery of the piston D is reduced in diameter to provide a recessed wall 50 slidably engaged with the cylindrical inner wall 52 of a ring or flange 54 mounted on the lower end of the sleeve or ring 30 and fastened thereto by means of bolts 56. An annular groove is provided in the surface 52 of ring 54 for receiving a sealing ring 58 in sealing engagement with the surface 50 of the reduced diameter portion of the piston D.

The bottom surface of the piston D rests on the upper surface of the platen C. Thus, any forces exerted downwardly on the piston D are transferred directly to the upper surface of the platen C over a substantial area thereof.

The ring or sleeve E has an outer cylindrical surface 70 in sliding sealing engagement with the cylindrical wall 22 and packing 24 and has an inner cylindrical surface 72 with which the second piston F is in sliding sealing engagement. The piston F has circumferential grooves in its outer surface adjacent the lower end thereof containing sealing rings 80. The lower annular end surface 82 of the sleeve E is spaced from the upper surface 48 of the piston D by a plurality of spacers 83 leaving a space therebetween through which hydraulic fluid, which ultimately fills the space, may flow between the surfaces 48 and 82. The sleeve E and spacers 83 are fastened to the piston D by means of bolts 90.

A radial passage 100 and a vertical passage 102 intersecting therewith are provided in the upper plate B to afford a conduit whereby hydraulic fluid can be supplied to the interior of the device, i.e. to the cavity 104 between the lower piston D and the upper piston F and plate B. This passage 100 at its outer radial end is threaded as at 106 to receive a hydraulic fitting (not shown).

The ring 54 has a radial passage 110 intersecting with an angled vertical passage 112 communicating with the space 113 defined by the cylindrical surfaces 50 and 32. This passage, which is threaded at its outer end as at 114, normally provides a vent although if desired air under pressure can be supplied thereto which will form means biasing the piston D to the vertically up position.

Biasing means in the form of helical compression coil springs 120 are positioned about each pillar G in the space between the base plate A and platen C and compressed therebetween. These may be used in place of or in conjunction with air under pressure in space 113.

The upper surface of the second or force piston F has a bore 138 therein in which is slidably positioned a plunger 140 biased upwardly by a helical coil spring 142 engaging the bottom of the bore 138 and the inner end of a well opening 144 in the lower surface of the plunger 140. This plunger has an upwardly facing shoulder 148 spaced between its upper and lower ends which should engage the bottom surface of a retaining plate 150 mounted on the upper end of the upper piston F and held thereon by means of simple fastening means such as the screws 152. The plunger 140 in turn has an upper end portion 156 of reduced diameter normally intended to engage in a suitably and similarly dimensioned well opening in the bottom of the ram 160 of a punch or arbor press. The plunger 140 can be dimensioned so that the force multiplying apparatus can be made to accommodate arbor or punch presses having different maximum throat openings. The portion 156 of the plunger extends into an opening 162 in the lower end of the ram 160 so as to accurately locate the apparatus as to be on the centerline of the ram or platen of the punch press.

In operation, the space or cavity 104 defined by the lower surfaces of the piston F and upper plate B, the upper surfaces 44, 48 of the platen piston D, the cylindrical side walls 72 and the cylindrical side walls 32 is filled completely with a hydraulic fluid. When a force is exerted downwardly on the second or force piston F, this same force is transmitted to the hydraulic fluid in the cavity through the lower surface 164 of the piston F. This results in a hydraulic pressure in the hydraulic fluid equal to the force applied to the upper end of the piston F divided by the area of the surface 164.

This hydraulic pressure is transmitted to all other surfaces defining the cavity 104 in which the hydraulic fluid is positioned. The hydraulic pressures on the upwardly facing surfaces 44, 48 of the piston D exert a force downwardly on the piston D equal to the hydraulic pressure of the fluid multiplied by the total upwardly facing surface area 44, 48 of the piston D which area, for the purposes of the invention and as shown, is substantially greater than the area of the lower surface 164 of the upper piston F. In a like manner, the hydraulic pressures exert an upward force on the downwardly facing annular end surface 82 on the lower end of the sleeve or ring E equal to the area of the exposed portions of surface 82 multiplied by the hydraulic pressure. This force is transmitted through bolts 90 to piston D and is in opposition to the downward force thereon.

Inasmuch as the total area of the surfaces 44, 48 of the lower piston D is, as mentioned above, substantially greater than the sum of the area of the surfaces 82 and 164, the total force downwardly on the platen C therefore is substantially greater than the forces downwardly on the upper piston F. The difference in the two forces is exerted upwardly against the lower surface of the upper plate B and this force is then transmitted to the lower plate A through the pillars G.

It will thus be seen that a force multiplier for a punch or arbor press has been described which enables a force to be applied on a workpiece placed between the base plate A and the platen C substantially greater than the force applied by the punch or arbor press to the force piston F. This increase in force is obtained by employing a large total work stroke of the arbor or punch press. This is not detrimental because the apparatus is primarily intended for blanking out operations wherein a flat piece of metal is sheared from a flat sheet of metal prior to subsequent forming operations. As such, the blank when it is sheared from the original sheet of metal has a lesser total overall height than it will have at any time thereafter as a result of the forming operations to be performed thereon by the punch or arbor press. Thus, for the blanking operation, it is possible to accept the lesser throat opening of a press provided with the force multiplying device to obtain an increased blanking out force. In this connection, because of the comparative vertical compactness of the force multiplier, the incorporation thereof in a conventional arbor or punch press can be accomplished without unduly reducing the throat opening of the press to an unacceptable extent for most work applications.

The invention has been described with reference to a preferred embodiment. Obviously, modifications and alterations will occur to others after a reading and understanding of this specification and it is my intention to include all such modifications and alterations insofar as they come within the scope of the appended claims.

Having thus described my invention, I claim:

1. A force multiplier for a punch or arbor press comprising in combination a base plate, a top plate and pillars holding said plates in rigid vertically spaced relationship, a platen member between said plates and movably guided by said pillars, means biasing said platen upwardly, a cylinder of a first diameter extending downwardly from the lower surface of said upper plate, a first piston member slidable in said cylinder and at its lower surface abutting the upper surface of said platen, said upper plate having a cylindrical opening therethrough of a second diameter less than said first diameter, a sleeve slidable in said opening and having an inner cylindrical wall of a third diameter less than said second diameter, a second piston slidable in said sleeve and extending above said sleeve, the space defined by said cylinder and said pistons being filled with a hydraulic fluid whereby forces on said second piston will exert through said hydraulic fluid a force downwardly on the platen greater than the force on the second piston.

2. The apparatus of claim 1 wherein said first piston has a lower outer portion of reduced diameter and said cylinder has a flange on its lower end having a surface in sliding sealing engagement with said portion.

3. The apparatus of claim 1 wherein said biasing means comprise springs positioned about said pillars.

4. The apparatus of claim 2 wherein said biasing means comprise compressed air admitted to the space defined by the said reduced portion on the lower end of the first piston and said flange.

5. The apparatus of claim 1 wherein said second piston has a plunger slidable in its upper end and spring means biasing it upwardly.

* * * * *